US008393126B1

(12) United States Patent
Watson

(10) Patent No.: US 8,393,126 B1
(45) Date of Patent: Mar. 12, 2013

(54) TORSIONAL BRACES

(75) Inventor: Dennis P. Watson, Oklahoma City, OK (US)

(73) Assignee: Building Concepts, Ltd., Oklahoma City, OK (US)

( * ) Notice: Subject to any disclaimer, the term of this patent is extended or adjusted under 35 U.S.C. 154(b) by 418 days.

(21) Appl. No.: 12/428,296

(22) Filed: Apr. 22, 2009

(51) Int. Cl.
*E04C 3/00* (2006.01)

(52) U.S. Cl. ..... 52/696; 52/643; 52/692; 52/712

(58) Field of Classification Search ..... 52/643, 52/692, 693, 696, 703, 712, 714, 715, 702, 52/317; 403/316, 318, 319
See application file for complete search history.

(56) References Cited

U.S. PATENT DOCUMENTS

| | | | | |
|---|---|---|---|---|
| 2,964,807 | A * | 12/1960 | Kennedy | 52/696 |
| 3,503,641 | A * | 3/1970 | Fraser | 403/327 |
| 3,946,532 | A * | 3/1976 | Gilb | 52/692 |
| 3,973,367 | A * | 8/1976 | Johnson et al. | 52/262 |
| 3,985,459 | A * | 10/1976 | Gilb | 403/217 |
| 4,246,736 | A * | 1/1981 | Kovar et al. | 52/696 |
| 4,408,423 | A * | 10/1983 | Lautensleger et al. | 52/90.1 |
| D293,416 | S * | 12/1987 | Krueger | D8/373 |
| D318,785 | S * | 8/1991 | Dean | D8/373 |
| 5,412,920 | A * | 5/1995 | Hess | 52/712 |
| 5,884,448 | A * | 3/1999 | Pellock | 52/643 |
| 6,354,055 | B1 * | 3/2002 | Shaw et al. | 52/712 |
| 6,393,794 | B1 * | 5/2002 | Pellock | 52/696 |
| 6,412,233 | B1 * | 7/2002 | Jones | 52/92.2 |
| 6,607,086 | B1 * | 8/2003 | Gretz | 52/702 |
| 6,742,310 | B1 * | 6/2004 | Weeks | 52/92.2 |
| 7,134,252 | B2 * | 11/2006 | Thompson | 52/712 |
| 7,213,377 | B1 * | 5/2007 | Sackett | 52/696 |
| 7,377,048 | B2 * | 5/2008 | Koetter | 33/613 |
| 7,617,612 | B2 * | 11/2009 | Brizendine | 33/613 |
| 7,752,823 | B2 * | 7/2010 | Robinson et al. | 52/664 |
| 2002/0092259 | A1 * | 7/2002 | Crawford et al. | 52/696 |

FOREIGN PATENT DOCUMENTS

AU 9944488 A * 3/2000

OTHER PUBLICATIONS

Sears, Jeff and Seek, Mike: "Anchorage of Bracing for Purlin Roof Systems Under Gravity Load With Top Flange Connected to Metal Sheathing to the 2007 North American Specification for the Design of Cold-Formed Steel Structural Members." Power Point Presentation, Oct. 24, 2008.

* cited by examiner

*Primary Examiner* — Brian Glessner
*Assistant Examiner* — Adriana Figueroa
(74) *Attorney, Agent, or Firm* — Tomlinson Rust McKinstry Grable

(57) ABSTRACT

A method and apparatus for preventing twisting of at least one purlin. A roof construction has purlins extending between support beams to provide extra stability for the roof. To prevent purlins from twisting, a torsional brace is provided. A beam of the torsional brace extends between two of the purlins. A static clip is connected to a purlin, and a pin is used to secure one end of the beam to the clip. The other end of the beam can be similarly clipped to another purlin, or alternatively, the other beam can be bolted to the purlin.

8 Claims, 4 Drawing Sheets

TORSIONAL BRACES

FIELD OF THE INVENTION

The present invention relates generally to torsional braces for use with a roof construction.

SUMMARY OF THE INVENTION

The present invention is directed to a roof construction. The roof construction comprises at least two purlins and at least one purlin brace assembly. The purlin brace assembly extends between two of the at least two purlins and comprises two ends. The purlin brace assembly comprises a beam, a static clip, and a pin. The static clip is attachable to one of the at least two purlins and the pin is attachable to the static clip and the beam proximate at least one of the two ends of the purlin brace assembly.

In another embodiment, the invention is directed to a method for preventing twisting of a purlin. The method comprises the steps of connecting a first static clip to a first purlin at a first connection point, connecting a second static clip to a second purlin at a second connection point, placing a beam proximate the first connection point and the second connection point, using a first pin to connect the first static clip to the beam, and using a second pin to connect the second static clip to the beam.

In still another embodiment, the invention is directed to a roof construction. The roof construction comprises a plurality of support beams, at least two purlins extending between two of the plurality of support beams, a means for stabilizing two of the at least two purlins. The means for stabilizing two of the at least two purlins extends from a first of the at least two purlins to a second of the at least two purlins.

DETAILED DESCRIPTION OF THE DRAWINGS

Metal roofs are often used to provide durable, stable roof constructions for structures including commercial and industrial buildings, aircraft hangars, and housing. Due to the relatively low weight relative to the strength of metal materials, relatively few load-bearing support beams can support the weight of the roof construction. Purlins are often used between support beams to support the weight of the roof panels. However, the strength and support of purlins may be degraded when a section of purlin undergoes a "twisting" force. Purlins may have a variety of cross-sections, including C, singly symmetric, or Z shapes. If there is no lateral or torsional restraint from the sheathing, Z sections will move vertically and deflect laterally as a result of the inclined principal axes, while C-sections will move vertically and twist as a result of the eccentricity of the load from the shear center. When twist of a purlin is prevented, a section may deflect laterally and retain its strength.

Figure 1:
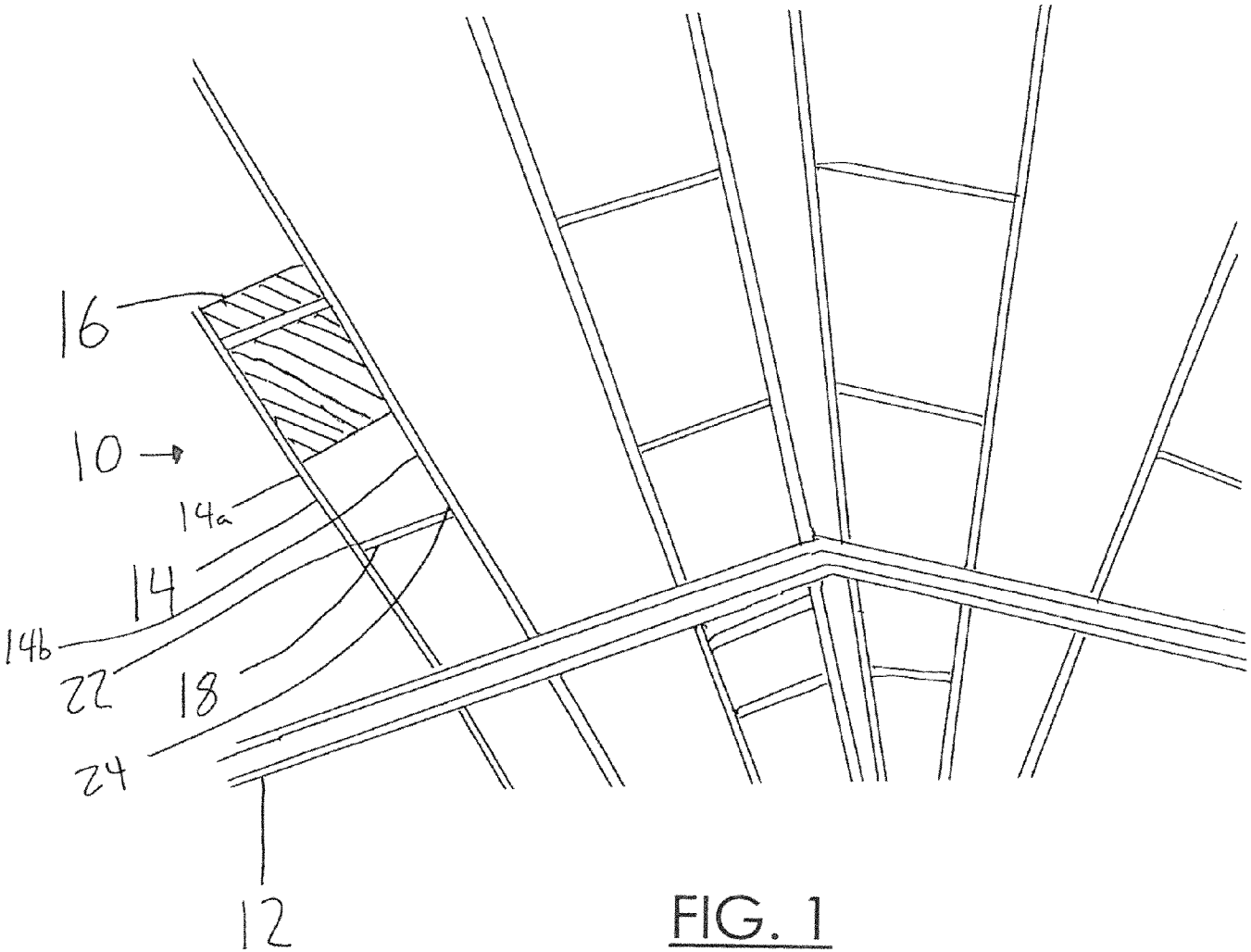
FIG. 1 is a bottom perspective view of the roof construction of the present invention.

Turning to the drawings in general and FIG. 1 in particular, shown therein is a roof construction 10 of the present invention. The roof construction comprises a plurality of support beams 12. The roof construction further comprises a plurality of purlins 14 supported by and horizontal to the support beams 12. Preferably, the purlins 14 are "z-purlins". In building fabrication, often purlins 14 will be used to support an upper roof panel 16. When the roof panel 16 is slanted, as shown in FIG. 1, the purlins 14 tend to twist, due to forces that are oblique to the principal axis of the purlin 14. For illustrative purposes, a downgrade purlin 14*a* and an upgrade purlin 14*b* are shown. The present invention is directed to a torsional brace 18 for increased stability of the roof construction 10 and limitation of the tendency to twist referenced above.

Figure 2:
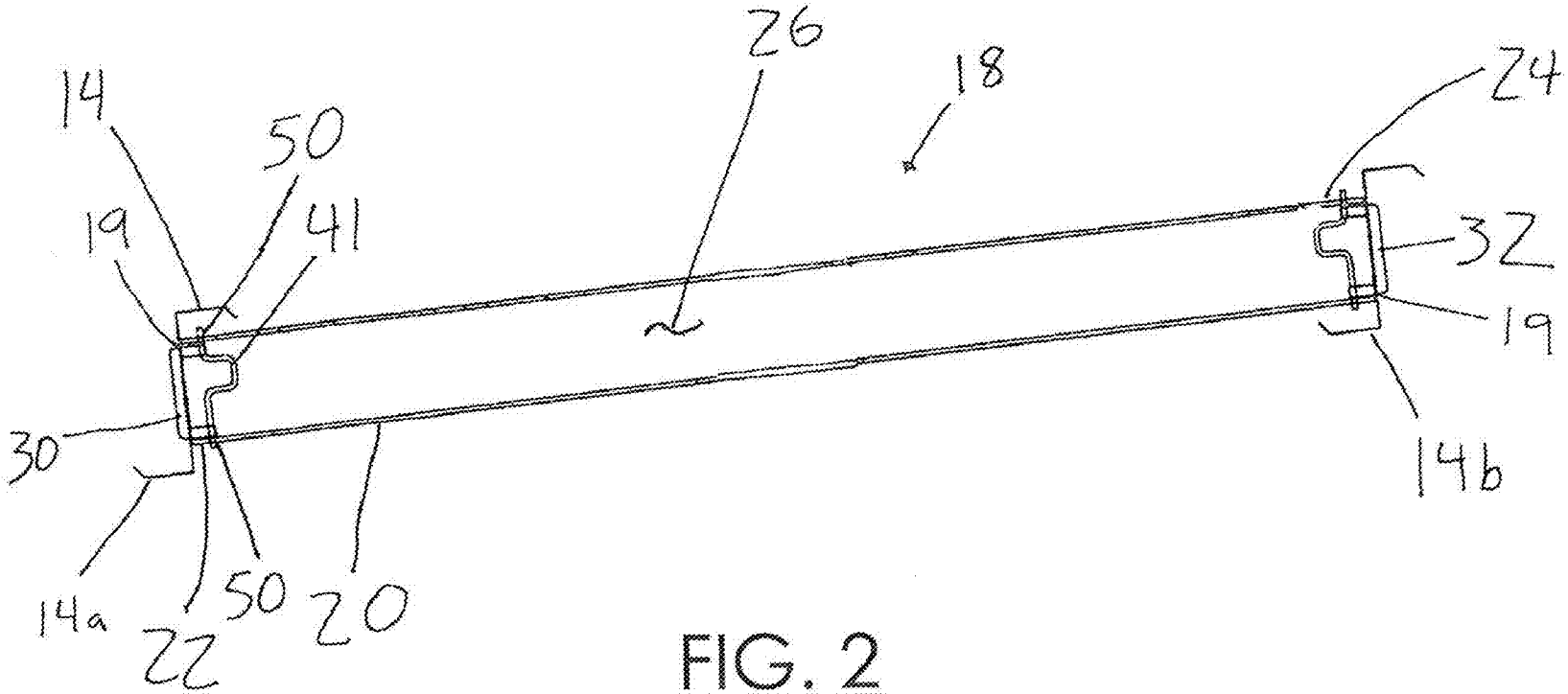
FIG. 2 is a side view of a torsional brace in accordance with the present invention.

Turning now to FIG. 2, the torsional brace 18 for the plurality of purlins 14 (FIG. 1) is shown in more detail. As shown, each of the plurality of purlins comprises purlin holes 19. Preferably, the purlin holes 19 are factory-punched during fabrication of the purlins 14. The brace 18 comprises a brace beam 20 defining a first end 22, a second end 24, a channel 26, at least one purlin brace clip 30, and at least one pin 41. The purlin holes 19 are formed in the generally vertical portion of the purlin 14 and sized to receive the purlin brace clip 30. Preferably, the first end 22 and the second end 24 comprise brace holes 50 on opposite sides of the channel 26. Each torsional brace 18 is sized such that the distance between the first end 22 and the second end 24 corresponds to a perpendicular distance between two purlins 14 and adapted to connect with a static clip or brace clip 30 at the first end 22 and a second brace clip 32 at the second end 24. In an alternative embodiment (not shown), the torsional brace 18 may be connected to a purlin 14 by the static clip 30 and pin 41 at one end, and connected to another purlin at the other end by bolts.

Figure 3:
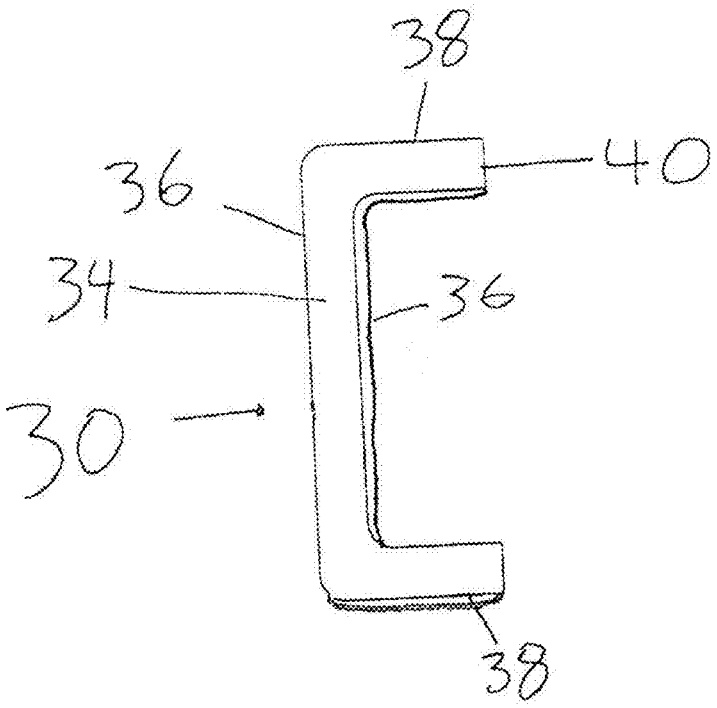
FIG. 3 is a side view of a static brace clip for use with the present invention.

With reference now to FIG. 3, the brace clip 30 is shown in more detail. As shown, the brace clip 30 comprises a generally C-shaped bracket 34. The bracket 34 comprises a pair of elongate sides 36 and a pair of attachment sides 38. The attachment sides are folded over such that the elongate sides 36 are in parallel planes and the midpoints of the attachment sides comprise pin attachment points 40. In a preferred embodiment, the distance between the elongate sides 36 is five-sixteenths of an inch. The brace clip 30 is sized such that the attachment sides fit through the purlin holes 19 (FIG. 2) such that the attachment points 40 are on one side of the purlin 14 while the elongate sides 36 are on the other side of the purlin. While a C-shaped steel bracket 34 is shown in FIG. 3 for exemplary purposes, one skilled in the art could anticipate that other shapes, sizes and materials could be utilized without departing from the scope and spirit of the present invention.

Figure 4:
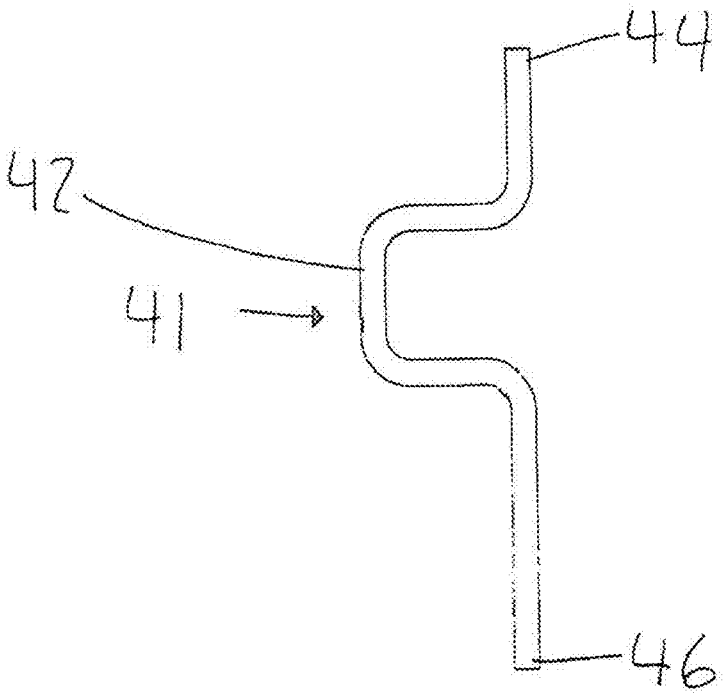
FIG. 4 is a side view of a pin for use with the present invention.

With reference now to FIG. 4, the pin 41 is shown in more detail. The pin 41 comprises an offset portion 42, a first end 44, and a second end 46. As shown, the pin 41 is sized such that the first end 44 is closer to the offset portion 42 than the second end 46. With reference again to FIG. 2, the pin 41 is further sized such that the first end 44 and the second end 46 extend across the channel 26 and through the brace holes 50 at an end 22, 24 of the torsional brace 18. The pin 41 interfaces with the brace clip 30 at the attachment points 36. In a preferred embodiment, the material for the pin 41 is one-quarter inch cold-rolled steel, though one skilled in the art will appreciate that other materials can be used. Preferably, the offset portion 42 is offset one and three-quarters inches from a line between the first end 44 and the second end 46 of the pin 41. As shown in FIG. 4, the offset portion 42 is rectangular, though other shapes, such as semi-circular or triangular, are anticipated.

Figure 5:
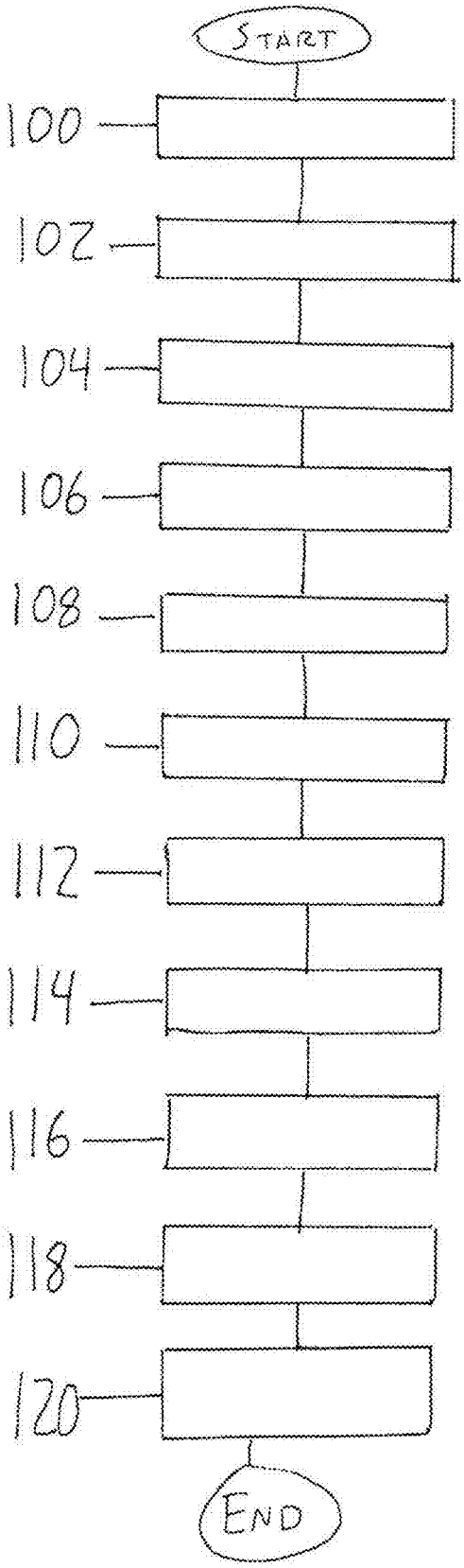
FIG. 5 is a process flow chart in accordance with the method of the present invention.

With reference now to FIG. 5, a method for installation of the torsional braces 18 to prevent twisting of a purlin 14 is shown. Prior to installation, roof purlins 14 should be bolted into place at step 100. The torsional brace 18 is installed prior to installation of roof panels 16 in the roof construction 10. With the plurality of purlins 14 in place, the first brace clip 30 is inserted through the purlin holes in one of the purlins 14 at step 102. Preferably, the first brace clip 30 is inserted into a first, or downgrade purlin 14*a* (FIG. 1) at step 102. The clip 30 is held in place and the pin 41 is inserted at step 104. Likewise, at step 106, the second brace clip 32 is inserted through the purlin holes 19 in one of the plurality of purlins opposite the first brace clip 30, such that the braces are placed at each end of the desired placement of the torsional brace 18. Preferably, the second brace clip 32 is inserted into a second, or upgrade purlin 14*b* (FIG. 1) at step 106.

A torsional brace 18 is selected for attachment at step 108. The first end 22 of the brace 18 is placed adjacent to the attachment points 40 of the first clip 30 at step 110. One of the brace holes 50 are placed on the pin 41 at step 112, and the pin is placed through the first clip 30 at step 114. The pin 41 is then dropped through a second of the brace holes 50 at step 116. The process is repeated for the second end 24 and the second clip 32 at step 118. Examination is then done at step 120 to ensure that each end 44, 46 of each pin 41 properly protrudes through the brace holes 50. Preferably, the first end 22 is downgrade from the second end 24 (FIG. 1).

With reference again to FIG. 2, the invention further comprises a method for preventing twisting of a purlin 14. First, the first static brace clip 30 is connected to the first purlin 14*a* at a first connection point 80 at step 102. The second static brace clip 32 is connected to the second purlin 14*b* at a section connection point 90 at step 106. The brace beam 20 is placed proximate the first 80 and second 90 connection points at steps 110 and 118. One of the pins 41 is used to connect the first static clip 30 to the beam 20 at 116. Another of the pins 41 is used to connect the second static clip 32 to the beam 20 at 118.

Various modifications in the design and operation of the present invention are contemplated without departing from the spirit of the invention. For example, the braces 18 and clips 30 are sealable and can be applied to a variety of different roof constructions 10. Thus, while the principal preferred construction and modes of operation of the invention have been illustrated and described in what is now considered to represent its best embodiments it should be understood that the invention may be practiced otherwise than as specifically illustrated and described.

What is claimed is:

1. A roof construction comprising:

at least two purlins having a first side and a second side, wherein the first side is opposite to the second side; and at least one purlin brace assembly extending between two of the at least two purlins and comprising two ends, the purlin brace assembly comprising:

a beam defining a pair of vertically opposed holes;

a static clip, attached to one and only one purlin; and a pin attached to the static clip and the beam proximate at least one of the two ends of the purlin brace assembly, wherein the pin is attached to the beam through tile pair of vertically opposed holes;

wherein the static clip is located on the first side of the purlin and the beam is located on the second side of the purlin.

2. The roof construction of claim 1 wherein the beam is secured to one of the at least two purlins at its end.

3. The roof construction of claim 1 wherein the beam is substantially perpendicular to one of the at least two purlins.

4. The roof construction of claim 1 wherein the purlin brace assembly further comprises a second static clip, attachable to one of the at least two purlins.

5. The roof construction of claim 4 wherein the purlin brace assembly further comprises a second pin attachable to the static clip or the second static clip and the beam proximate at least one of the two ends of the purlin brace assembly.

6. A method for preventing twisting of a purlin, comprising the steps of:

connecting a first static clip to a first purlin at a first connection point;

wherein the first purlin has a first side and a second side, wherein the first side is opposite to the second side;

connecting a second static clip to a second purlin at a second connection point;

wherein the first static clip is connected to the first side of one and only one purlin and the second static clip is connected to one and only one purlin;

placing a beam at the second side of the first purlin proximate the first connection point and the second connection point, wherein the beam comprises a first pair of vertically opposed holes placed proximate the first connection point and a second pair of vertically opposed holes placed proximate the second connection point;

placing a first pin through the first pair of vertically opposed holes to connect the first static clip to the beam; and placing a second pin through the second pair of vertically opposed holes to connect the second static clip to the beam.

7. The method of claim 6 wherein the first purlin is downgrade of the second purlin.

8. A roof construction comprising:

a plurality of support beams;

at least two purlins extending between two of the plurality of support beams; and a means for stabilizing two of the at least two purlins, extending from a first of the at least two purlins to a second of the at least two purlins;

wherein the means for stabilizing two of the at least two purlins comprises:

a beam defining an opposed pair of vertically disposed holes;

a static clip, attached to one and only one purlin at an opposite side of the purlin from the beam; and a pin attached to the static clip and the beam proximate at least one of the two ends of the purlin brace assembly, wherein the pin is attached to the beam through the opposed pair of vertically disposed holes.

* * * * *